United States Patent [19]

Klahn et al.

[11] 4,151,674

[45] May 1, 1979

[54] FLYING CYLINDER

[76] Inventors: Dale H. Klahn, 2572 La Conte Ave., Berkeley, Calif. 94709; Gary L. Upham, 3375 Picadilly Dr., San Jose, Calif. 95118

[21] Appl. No.: 696,086

[22] Filed: Jun. 14, 1976

[51] Int. Cl.[2] ..... A63H 33/18

[52] U.S. Cl. ..... 46/74 R; 46/74 D; 273/106 R

[58] Field of Search ..... 46/74 R, 74 D; 244/34 A, 41; 273/106.4, 106 R; 113/80

[56] References Cited

U.S. PATENT DOCUMENTS

| | | | |
|---|---|---|---|
| 1,317,001 | 9/1919 | Clymer et al. | 113/120 BB |
| 1,381,435 | 6/1921 | Rude | 113/120 BB |
| 1,446,158 | 2/1923 | Clymer et al. | 113/120 BB |
| 2,209,209 | 7/1940 | Ruby | 113/120 BB |
| 2,523,285 | 9/1950 | Erb | 113/120 BB |
| 2,683,603 | 7/1954 | Gackenbach | 273/106 R |
| 2,739,770 | 3/1956 | Fanti et al. | 244/41 |
| 2,800,291 | 7/1957 | Stephens | 244/41 |
| 3,264,776 | 8/1966 | Morrow | 46/74 R |
| 3,359,678 | 12/1967 | Headrick | 46/74 D |
| 3,578,264 | 5/1971 | Kuethe | 244/41 |
| 3,922,984 | 12/1975 | Zuidveld et al. | 113/120 BB |

*Primary Examiner*—Russell R. Kinsey
*Assistant Examiner*—Robert F. Cutting
*Attorney, Agent, or Firm*—Townsend and Townsend

[57] ABSTRACT

An improved flying cylinder and method of constructing the cylinder is disclosed. The cylinder includes a hollow cylindrical body having a leading end and a trailing end, the center of gravity of the cylindrical body being located relatively toward the leading end. The cylinder is adapted to be propelled through the air with axial spin. A boundary layer tripping mechanism is located circumferentially around the exterior surface of the leading end of the cylindrical body. This mechanism provides the cylinder with a turbulent boundary layer as it is propelled through the air to reduce drag and improve the flying characteristics of the cylinder.

3 Claims, 12 Drawing Figures

FLYING CYLINDER

BACKGROUND OF THE INVENTION

This invention relates to flying mechanisms and in particular to a cylinder adapted to be propelled through the air with axial spin.

A wide variety of flying toys have been developed for amusement, and which are normally used in various games of catch or other types of amusement. Many of these devices are quite popular. However, one type of flying toy which has not achieved the popularity of many others is the flying cylinder, as illustrated in the patent to Morrow, U.S. Pat. No. 3,364,776. While cylinders of this type do exert certain desirable flying characteristics when properly thrown, the lift to drag ratio is sufficiently low so that the flying cylinder does not fly well enough to provide an attractive amusement device.

SUMMARY OF THE INVENTION

The present invention provides an improved flying cylinder and method of making the cylinder. The cylinder includes a hollow cylindrical body having a leading end and a trailing end, the center of gravity of the cylindrical body being located relatively toward the leading end. The cylinder is adapted to be propelled through the air with axial spin. A boundary layer tripping mechanism is located circumferentially around the exterior surface of the leading end of the cylindrical body. This mechanism provides the cylinder with a turbulent boundary layer as the cylinder is propelled through the air to reduce drag and improve the flying characteristics of the cylinder.

It has been found that the boundary layer tripping mechanism provided by the present invention greatly improves the flying characteristics of the device. It is believed that the turbulent boundary layer resulting from the tripping mechanism increases the lift and decreases the drag, improving the lift to drag ratio of the device and hence its ability to fly through the air. In fact, the device of the present invention can be thrown relatively long distances with a simple flick of the wrist and therefore provides an extremely appealing and useful amusement device.

In a preferred embodiment of the present invention, the boundary layer tripping mechanism comprises a rearwardly directed ledge. It has been found that such a rearwardly directed ledge is generally found on one side of most aluminum beverage containers having a seam formed during the construction of the container. By removing the end wall near the seam from the container and by also removing the other end wall and a portion of the side wall from the container the device of the present invention can be readily constructed. The seam weights the device towards the leading end. In addition, the reverse ledge at the base of the seam provides a boundary layer tripping mechanism which accomplishes the objects of the present invention. The resulting construction is extremely light weight and has excellent flying characteristics.

In addition to the rearwardly directed ledge of the preferred embodiment, various other boundary layer tripping mechanisms could be used instead of or in addition to such a ledge. For example, the outer leading edge of the device could be knurled or roughened, and one or more grooves could be used rather than the ledge. In addition, it has been found that the flying characteristics of the device can be modified by providing one or more circumferential rings of apertures near the leading end of the device which apparently allow for air flow between the inner and outer walls of the device. It has been found that this modification results in straighter flights and causes the device to generate a whistling sound when in flight.

The novel features which ae characteristic of the invention, both as to organization and method of operation, together with further objects and advantages thereof will be better understood from the following description considered in connection with the accompanied drawings which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
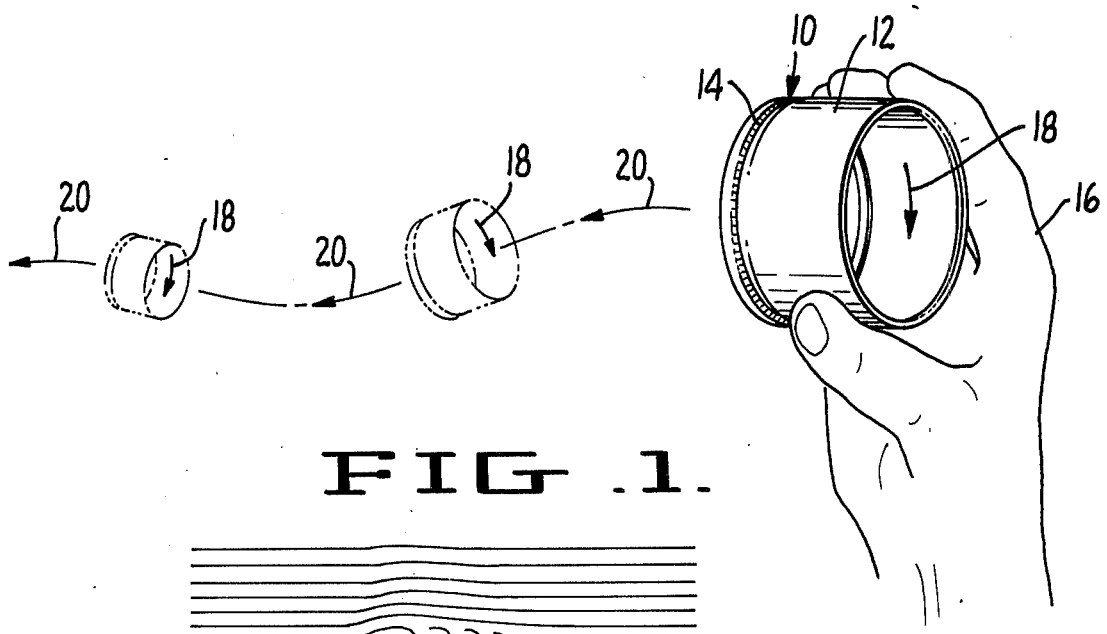
FIG. 1 is a perspective view illustrating the operation of the flying cylinder of the present invention.

The operation of the flying cylinder 10 of the present invention is illustrated generally by way of reference to FIG. 1. Flying cylinder 10 includes a hollow cylindrical body 12 having a boundary layer tripping mechanism 14 located circumferentially about its leading end. Cylinder 10 is launched by hand 16 by tossing it with a flick of the wrist to impart axial spin to the device as illustrated by arrows 18. In this manner, flying cylinder 10 will be propelled through the air as illustrated by arrows 20.

It is contemplated that the flying cylinder 10 of the present invention will be used primarily in games of catch. It has been found that when properly thrown, th device will generally follow a more or less linear path. Perturbations can be introduced into the path by launching the device in different ways. For example, it has been found that when the device is launched forwardly and slightly downwardly with an upward tilt, it will fly down towards the ground and then tends to rise to the height of its initial launch. Other such perturbations can be introduced in the flight path of the cylinder so that the cylinder provides an exciting and varied amusement device.

Figure 2:
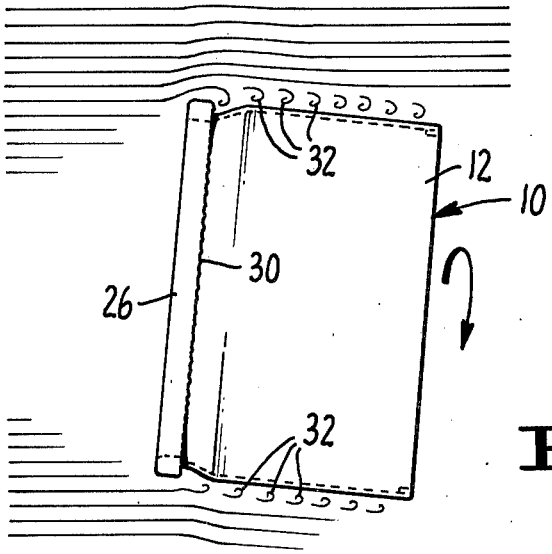
FIG. 2 is a side elevation view of the preferred embodiment of the present invention illustrating the axial air flow characteristics of the flying cylinder of the present invention.
Figure 3:
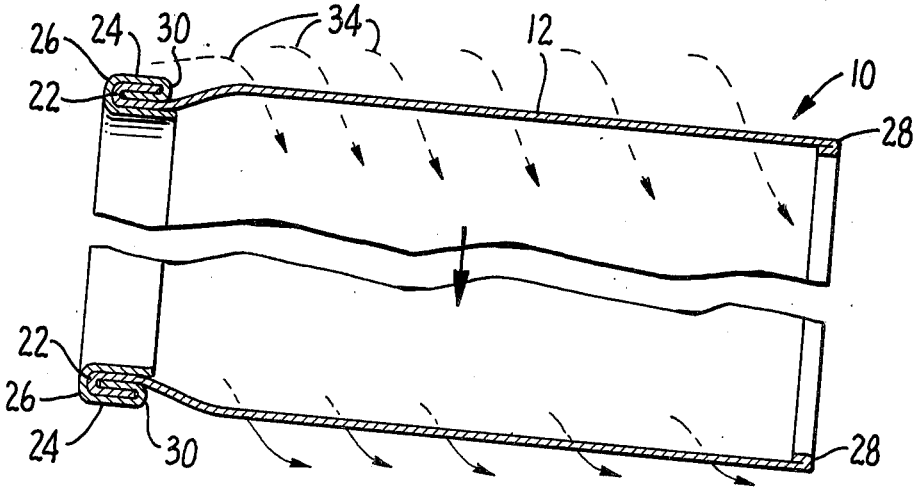
FIG. 3 is a cross sectional fragmentary view of the preferred embodiment illustrating the radial flow characteristics of the present invention.

The preferred embodiment 10 of the present invention is illustrated by way of reference to FIGS. 2 and 3. The leading end of cylindrical body 12 is folded over as illustrated at 22 at the leading end of the device to form an outwardly and rearwardly directed curl. An additional strip of metal 24 is interleaved with and wrapped around the curled end of cylindrical body 12. In this manner, a thickened portion 26 is formed at the leading end of cylindrical body 12.

Thickened portion 26 provides a weight concentration toward the leading end of cylindrical body 12. It has been found that the best flight characteristics for the device are achieved when the center of gravity of the device is located at a point approximately one-fourth of the distance from the leading end to the trailing end of the device. A slight wraparound 28 may be provided at the trailing end of cylindrical portion 12 for safety if material having a sharp edge is used to construct the device, but this wraparound should be relatively small so as not to upset the preferred weight distribution. Similarly, the trailing edge may be coated with a plastic material to achieve the same effect.

Thickened portion 26 ot only provides weight concentration at the leading end of cylindrical body 12, but also results in a rearwardly projecting ledge 30 being formed circumferentially around cylindrical body 12 proximate its leading end. Ledge 30 may be roughened as illustrated in FIG. 2.

When flying cylinder 10 is propelled through the air as illustrated in FIG. 2, it has been found that rearwardly directed ledge 30 provides a boundary layer tripping device. As a result, the air flow immediately proximate the outer surface of cylindrical portion 12 is disturbed so as to set up turbulance 32 and the cylinder has a turbulent boundary layer. This turbulent boundary layer prevents separation of the air flow along the outer surface of the cylinder which would be expected of a non-turbulent (i.e., laminar) boundary layer, reducing drag and increasing lift and greatly enhancing the flying characteristics of the device. In actuality, this boundary layer flows over the device in a spiral path due to the rotation of the device as illustrated by arrows 34 in FIG. 3, but the turbulent nature of the boundary layer is not changed.

Figure 4:
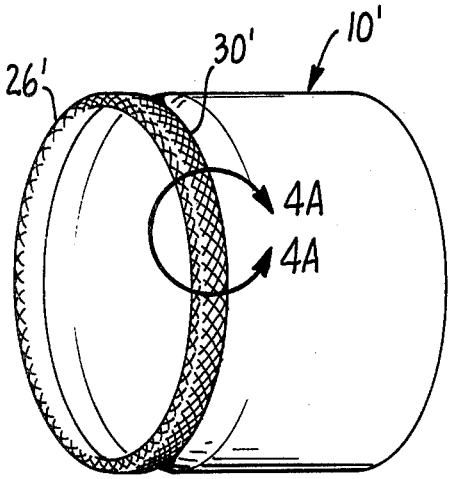
FIG. 4 is a perspective view of an alternate embodiment of the present invention.
Figure 4A:
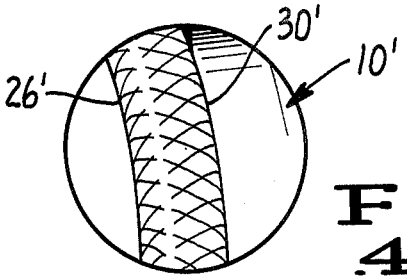
FIGS. 4A and 4B illustrate various forms of the boundary layer tripping mechanism thereof.
Figure 4B:
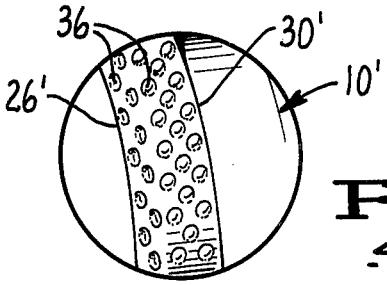

A system in which the boundary layer tripping mechanism illustrated in FIGS. 2 and 3 might be improved is illustrated in FIGS. 4 and 4A. Using reference numerals similar to previous figures for clarity, the alternate embodiment 10' of the flying cylinder illustrated in FIG. 4 has a rearwardly directed ledge 30' as in the previous embodiments. However, the outer surface of the thickened portion 26' of the device is knurled as illustrated to assure that the boundary layer is rendered fully turbulent. As illustrated in FIG. 4B, a roughened surface 36 might also be used to assure the boundary layer becomes fully turbulent. By providing such a fully turbulent boundary layer, the excellent flying characteristics of the present invention are achieved.

Figure 5:
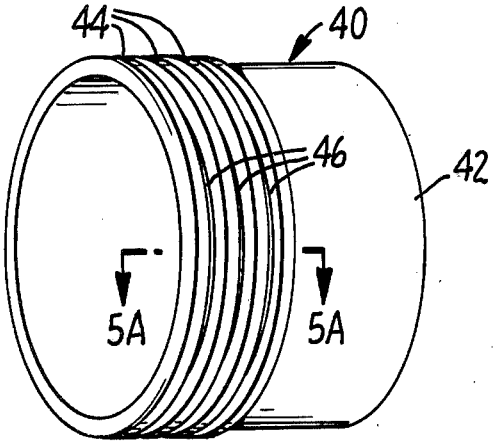
FIG. 5 is a perspective view of another alternate embodiment of the present invention.
Figure 5A:
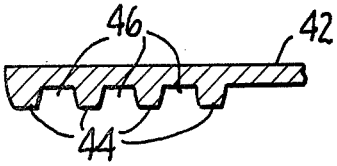
FIG. 5A is a cross sectional view of boundary layer tripping mechanism thereof.

Another alternate embodiment 40 of the flying mechanism of the present invention is illustrated by way of reference to FIGS. 5 and 5A. Embodiment 40 also includes a cylindrical body 42, as with the previous embodiments. A plurality of outwardly directed ridges 44 circumscribe the outer circumference of cylindrical body 42 toward the leading edge thereof. Ridges 44 provide weight concentration toward the leading end of cylindrical body 42 so that the center of gravity of cylinder 40 is located towards its leading end. Ridges 44 also provide a plurality of grooves 46 which serve to trip the boundary layer of the air flow over the outer surface of cylindrical body 42 to enhance the flying characteristics of the device.

Figure 6:
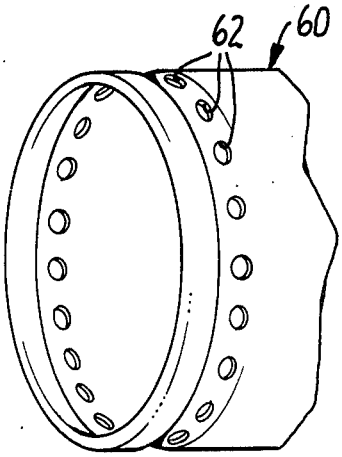
FIGS. 6 and 7 are fragmentary perspective views illustrating the incorporation of one or more rings of apertures in the flying cylinder of the present invention.
Figure 7:
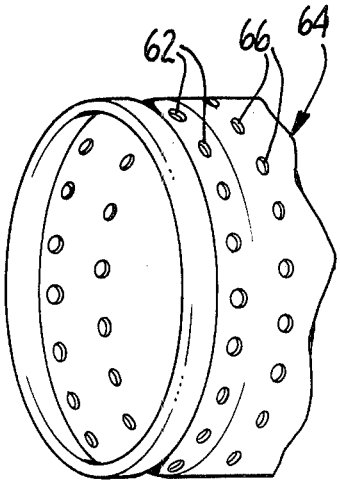

A further alternate embodiment 60 of the present invention is illustrated in FIG. 6. Embodiment 60 is generally similar to embodiment 10 previously illustrated except that a plurality of relatively small apertures 62 are located in a ring about the leading end of the device. Embodiment 64 illustrated in FIG. 7 is similar to that of FIG. 6 except that a second ring 66 of apertures are added. It has been found that these rings of apertures result in a straighter flight path of the cylinder. Presumably, apertures 62 and 64 allow for limited air flow between the inner and outer surfaces which stabilizes the center of lift of the flying mechanism which results in a straighter flight path. The whistling noise made by these apertures is also an attractive feature.

Figure 8:
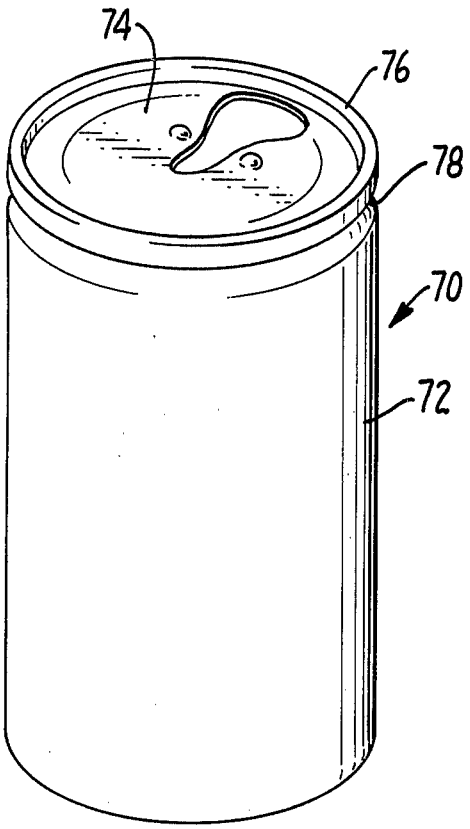
FIG. 8 is a perspective view of a standard aluminum beverage container from which the apparatus of the present invention can be constructed.

As discussed hereinabove, it has been found that the preferred embodiment of the present invention can be constructed from a conventional aluminum beverage container 70 as illustrated in FIG. 8. Container 70 includes a cylindrical side wall portion 72 and opposing end walls such as 74. Adjacent one end wall section 74, a seam 76 is provided which is necessary in the construction of the container. Seam 76 results in a thickened portion of the container being located proximate end 74, and a ledge 78 is provided at the bottom of seam 76.

Figure 9:
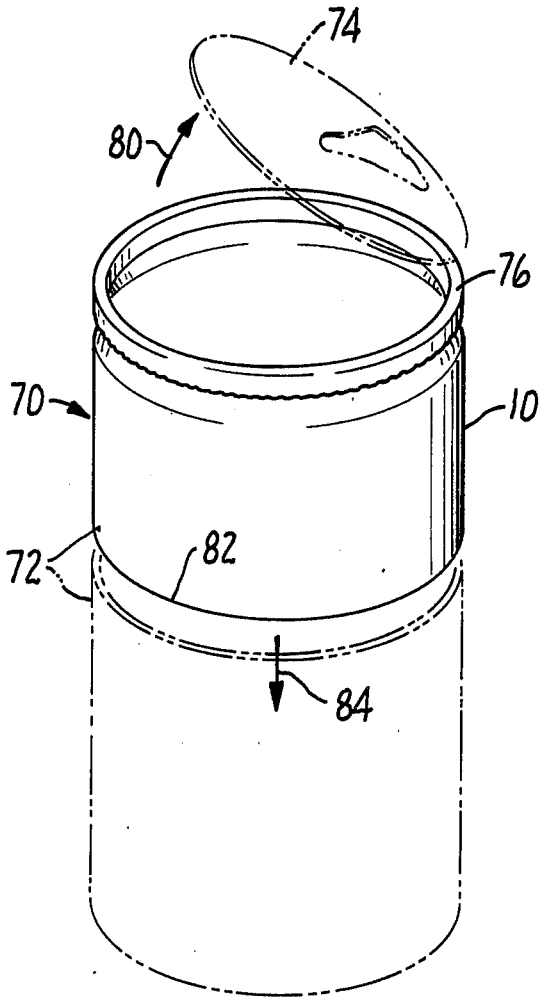
FIG. 9 illustrates the steps necessary to construct the apparatus of the present invention from the beverage container of FIG. 8.

The construction of the preferred embodiment 10 of the present invention from the beverage container 70 is illustrated by way of reference to FIG. 9. End wall 74 proximate seam 76 is removed as illustrated by arrow 80. It has been found that certain electric can openers can be used for the task. The cylindrical portion 72 of the can is circumferentially cut at 82 to remove a portion of the side wall of the container from remaining side wall portion as illustrated by arrow 84. Cut 82 is made in a standard beverage container having a diameter of about 2.5 inches so that the length of the remaining side wall portion is usually between about 1.65 and 1.75 inches and the center of gravity will be at or near the quarter chord. The end wall of container 70 opposite from end wall 74 is thus removed along with the excess portion of the side wall. The portion of container 70 remaining provides the flying cylinder 10 of the present invention.

While preferred embodiments of the present invention have been illustrated in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. A flying mechanism comprising:

a hollow cylinder constructed of two pieces of thin sheet material and having a leading end and a trailing end, said cylinder including a cylindrical body constructed of one of the pieces of sheet material, said one piece having an outwardly and rearwardly directed curl at the leading end of the cylinder, the other said piece of sheet material being interleaved with and at least partially circumscribing the curl of the first piece to provide a weight at the leading end of the cylinder and to provide a rearwardly directed ledge at said leading end to provide the cylinder with a turbulent boundary layer as the cylinder is propelled through the air to reduce drag and enhance the flying characteristics of said cylinder.

2. A flying mechanism as recited in claim 1 wherein said pieces of thin sheet material comprise aluminum.

3. A flying mechanism as recited in claim 1 and additionally comprising a plurality of apertures disposed about the circumference of the leading end of the cylinder body to further enhance the flying characteristics of the cylinder.

* * * * *